US007430383B2

(12) United States Patent
Tanabe

(10) Patent No.: US 7,430,383 B2
(45) Date of Patent: Sep. 30, 2008

(54) IMAGE FORMING DEVICE HAVING A MEMBER FOR PREVENTING DEVELOPER LEAKAGE

(75) Inventor: Satoshi Tanabe, Nagoya (JP)

(73) Assignee: Brother Kogyo Kabushiki Kaisha, Nagoy-shi, Aichi-ken (JP)

( * ) Notice: Subject to any disclaimer, the term of this patent is extended or adjusted under 35 U.S.C. 154(b) by 32 days.

(21) Appl. No.: 11/467,403

(22) Filed: Aug. 25, 2006

(65) Prior Publication Data

US 2007/0048002 A1 Mar. 1, 2007

(30) Foreign Application Priority Data

Aug. 26, 2005 (JP) ..... 2005-246026

(51) Int. Cl.
*G03G 15/08* (2006.01)

(52) U.S. Cl. ..... 399/103; 399/105

(58) Field of Classification Search ..... 399/103, 399/105, 106, 98
See application file for complete search history.

(56) References Cited

U.S. PATENT DOCUMENTS

| | | | | |
|---|---|---|---|---|
| 6,356,723 | B1 | 3/2002 | Sato et al. | |
| 6,496,669 | B2 | 12/2002 | Sato et al. | |
| 2005/0158070 | A1 * | 7/2005 | Ishii | 399/103 |
| 2006/0024085 | A1 * | 2/2006 | Sato et al. | 399/103 |
| 2006/0072934 | A1 * | 4/2006 | Fukuta | 399/103 |

FOREIGN PATENT DOCUMENTS

| | | | |
|---|---|---|---|
| JP | 60-135965 | A | 7/1985 |
| JP | 63-39247 | U | 3/1988 |
| JP | 1-79057 | U | 5/1989 |
| JP | 07-295377 | A * | 11/1995 |
| JP | 8-146760 | A | 6/1996 |
| JP | 10-239999 | A | 9/1998 |
| JP | 11-160996 | A | 6/1999 |
| JP | 2000-250309 | A | 9/2000 |
| JP | 2001-134080 | A | 5/2001 |

* cited by examiner

*Primary Examiner*—Sophia S Chen
(74) *Attorney, Agent, or Firm*—Banner & Witcoff, Ltd.

(57) ABSTRACT

A development apparatus for use in an image forming device includes a developer storage chamber for storing developer, a developer carrier having a film of the developer formed thereon, wherein a visible image is formed when the film interacts with an electrostatic latent image, and a developer feed member arranged adjacent to the opening of the developer storage chamber and configured to feed developer from the developer storage chamber to the developer carrier. A developer leakage prevention member is located between the developer feed member and the developer carrier and an adhesive adheres to the developer leakage prevention member in the longitudinal direction of the opening. Also, a layer including an agent is formed between the adhesive and the developer feed member.

23 Claims, 4 Drawing Sheets

IMAGE FORMING DEVICE HAVING A MEMBER FOR PREVENTING DEVELOPER LEAKAGE

CROSS REFERENCE TO RELATED APPLICATION

This application claims priority from Japanese Patent Application No. 2005-246026, filed on Aug. 26, 2005, the entire subject matter of which is incorporated herein by reference.

FIELD

Aspects of the present invention relate to a development apparatus performing development using charged micro particles as a developer, a process cartridge, a development apparatus cartridge, and an image forming device using one of the above.

BACKGROUND

In a development apparatus wherein the developing processing is carried out using toner, which is provided as charged micro particles as a developer and by depositing the toner as an electrostatic latent image, there is a problem with the leakage of toner from the development apparatus. If the leakage of toner occurs, the interior of the image forming device using the development apparatus is stained. As a result, printing failure may occur and an operator's hands and clothes may be soiled with the toner when the operator replaces the development apparatus.

In the case of non-magnetic single component developing wherein a toner film is formed with a film thickness regulating blade on the developing roller having functions of conveyance while carrying the toner and faced against the electrostatic latent image to proceed with developing process, leakage of toner occurs easily around the developing rollers that are rotating.

In order to prevent the leakage of toner from the direction of both ends of the developing roller, as in Japanese Laid Open Patent Application Publication 2001-134080, a side seal constituting a substrate of an end-to-end developer leakage prevention member slides on the circumferential face of the both ends of the developing roller, and a double-faced tape is used for installation in the case of the development apparatus.

At both ends of the feed roller for feeding a toner to the developing roller, a side end toner leakage prevention member called a feed roller seal is arranged to face both ends and a side seal is installed in the development apparatus case to cover the feed roller seal and prevent the leakage of toner from both ends of the feed roller.

In a development apparatus, when the toner (developer) becomes empty, it is replaced with a new development apparatus and the old development apparatus is recycled. When recycling the development apparatus, the old side seal (end-to-end developer leakage prevention member) is removed from the development apparatus case and a new side seal is installed. However, as mentioned above, since the side seal is installed using a double-faced tape in the case of the development apparatus, the side seal may be broken unless it is peeled properly. Peeling the side seal becomes more troublesome since residual side seal and double-faced tape (double-faced adhesive) must be further peeled off from the case of the development apparatus. In addition, installing a side seal at an appropriate position in the development apparatus case can become difficult due to the presence of double-faced tape on the back of the side seal. If the side seal adheres to the case of the development apparatus, it can be difficult to change the position of the side seal. In addition, when changing the position of the side seal, wrinkles and stretches frequently occur, which causes leakage of toner.

SUMMARY

At least some aspects of the present invention provide a development apparatus, process cartridge, development apparatus cartridge, and image forming device wherein the leakage of toner due to inappropriate installation of the toner leakage prevention member can be prevented. According to at least some aspects, the task of removing the old side seal (end-to-end developer leakage prevention member) from the development apparatus case, and installing a new side seal may be simplified.

According to at least one aspect of the invention, a development apparatus for use in an image forming device includes a developer storage chamber for storing developer, a developer carrier having a film of the developer formed thereon, wherein a visible image is formed when the film interacts with an electrostatic latent image, and a developer feed member arranged adjacent to the opening of the developer storage chamber and configured to feed developer from the developer storage chamber to the developer carrier. A developer leakage prevention member is located between the developer feed member and the developer carrier and an adhesive adheres to the developer leakage prevention member in the longitudinal direction of the opening. Also, a layer including an agent is formed between the adhesive and the developer feed member.

In other illustrative aspects, the developer apparatus may include a case containing a developer storage chamber for storing developer, a developer carrier having a film of the developer formed thereon, wherein a visible image is formed when the film interacts with an electrostatic latent image, and a developer feed member arranged adjacent to an opening of the developer storage chamber and configured to feed developer from the developer storage chamber to the developer carrier. Also, the case may include a developer leakage prevention member located between the case and the developer carrier, an adhesive located between the case and the developer leakage prevention member and adhering to the developer leakage prevention member in the longitudinal direction of the opening, and a layer including an agent contacting the adhesive and the case.

DETAILED DESCRIPTION

Illustrative aspects of the present invention are explained below with reference to the attached drawings.

Figure 1:
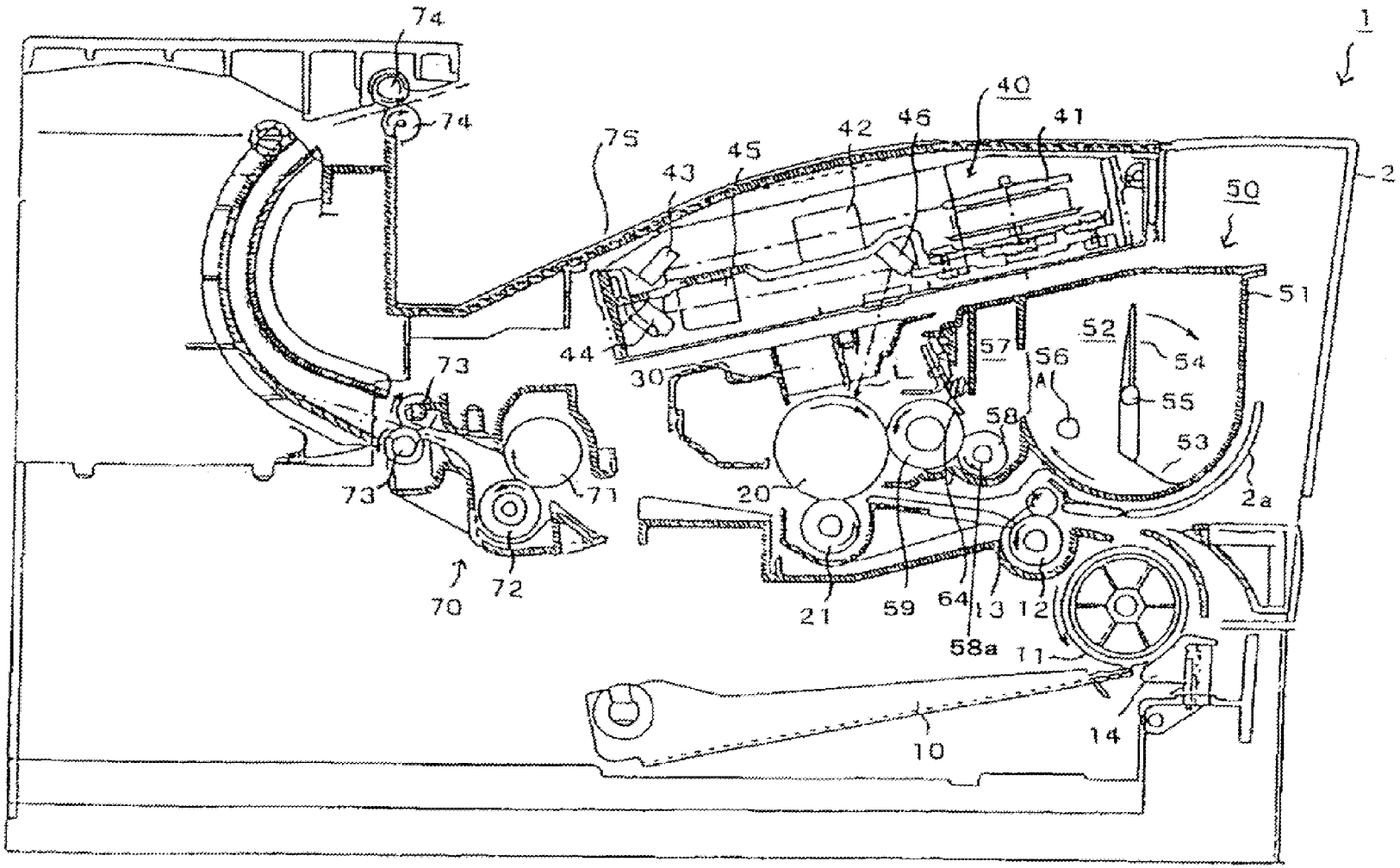
FIG. 1 is a cross-sectional view showing the overall configuration of an image forming device according to at least one aspect of the present invention.

FIG. 1 is a cross-sectional view showing an overall configuration of a laser beam printer 1 as an image forming device according to at least one aspect of the present invention. In FIG. 1, the laser beam printer 1 as an image forming device is equipped with a feeder unit for feeding a recording medium (e.g., paper) at the bottom of a body case 2. The feeder unit includes a press plate 10 that is pressed with a spring (not shown), a feed roller 11, and a friction separation member 14. The recording medium is pressed by the press plate 10 against the feed roller 11 and with rotation of the feed roller 11, a recording medium on the top of a stack (if more than one recording medium is present) is input between the feed roller 11 and the friction separation member 14 to feed the recording medium.

At the downstream side in the direction of recording medium transfer due to the rotation of the feed roller 11 rotating in the direction of the arrow in FIG. 1, a pair of resist rollers 12 and 13 is installed in a rotating position to carry the recording medium to the transfer position at a specified timing constituted by a photosensitive drum 20 and a transfer roller 21 to be discussed later.

The photosensitive drum 20 as a carrier of the electrostatic latent images is made of positively charged materials, for example, an organic photosensitive material primarily made of positively charged polycarbonate. Specifically, the photosensitive drum 20 includes a cylindrically-shaped aluminum cylindrical sleeve as a body, and a hollow drum forming a photoconductive layer with a specified thickness (e.g., approximately 20 μm) prepared by dispersing photoconductive resin in the polycarbonate. The cylindrical sleeve that is grounded is supported in a fully rotating manner through the body case 2. Moreover, the photosensitive drum 20 is driven to be rotated in the direction of the arrow using a driving means (not shown).

A charger 30 is constituted of, for example, a Scorotron type charger for positive charging that generates corona discharge from a wire for charging such as tungsten.

A laser scanner unit 40 includes a laser generator (not shown) for generating laser beam L for forming electrostatic latent images on the photosensitive drum 20, a polygon mirror (a pentahedron mirror) 41 to be rotated, a pair of lenses 42 and 45, and reflective mirrors 43, 44 and 46.

In a development apparatus 50, a toner storage chamber 52 containing a toner as a developer is constituted in a development apparatus case 51, and an agitator 53 and a cleaning member 54 are installed in a fully rotating manner around the rotary shaft 55 in the toner storage chamber 52. In this toner storage chamber 52, positively charged non-magnetic one-component developer having an electrical insulation is stored as a toner. A light transmitting window 56 is installed at the side wall located at both edges of the rotary shaft 55 of the toner storage chamber 52. Additionally, at the side of the photosensitive drum 20 of the toner storage chamber 52, an opening A is made as an opening part of the development apparatus case and a developing chamber 57 connects to the toner storage chamber 52 via this opening A in order to perform a developing process. Also, a feed roller 58 as a developer feed roller and a developing roller 59 as a developer carrier are supported in a fully rotating manner. The feed roller 58 and the feed roller shaft 58*a* constitute a developer feed member in order to feed a toner in the toner storage chamber 52 to the developing roller 59. The amount of toner on the developing roller 59 that is fed by the feed roller 58 is regulated to a specified layer thickness using a layer thickness regulating blade 64 having a thin plate elasticity.

The developing roller 59 contains a cylindrical substrate made of a conductive silicone rubber containing conductive carbon micro particles on the core metal made of stainless steel. Furthermore, a resin containing fluorine or a rubber material coat layer is constituted on this substrate. However, it is not always necessary that the substrate of the developing roller 59 be made of conductive silicone rubber; conductive urethane rubber may also be used.

Additionally, the toner stored in the toner storage chamber 52 is a positively charged non-magnetic one-component developer which contains toner base particles with a volumetric mean particle size of 10 μm with the particle size ranging from 5 μm to 15 μm. The particles are constituted in a spherical shape by suspension polymerization in which a known colorant such as carbon black and a charging control agent such as nigrosin, triphenylmethane, quaternary ammonium salts are added to a monomer mixture of styrene and acryl. The toner is then constituted by adding silica as an external additive on the surface of the toner base particles.

The transfer roller 21 is supported in a fully rotating manner and is made of a foaming elastomer having conductivity such as silicone rubber and urethane rubber. The transfer roller 21 is constituted such that a toner image on the photosensitive drum 20 is definitely transferred onto a recording medium when a voltage is applied.

The fixing unit 70 is installed at the downstream side in the transfer direction of the recording medium from the resist rollers 12 and 13 to the pressure contact units with the photosensitive drum 20 and the transfer roller 21, and also includes a heated roller 71 and a pressing roller 72. The toner image transferred on the recording medium is heated and pressed by the heated roller 71 and pressing roller 72 while being transferred to be fixed on the recording medium.

A pair of carriage rollers 73 and an ejection roller 74 for transferring the recording medium is installed at the downstream side in the direction of carriage in the fixing unit 70, and an ejection tray 75 is provided at the downstream side of the ejection roller 74.

The aforementioned photosensitive drum 20, transfer roller 21, charger 30 and development apparatus 50 are stored in a process cartridge 2*a*, and the process cartridge 2*a* is installed in a fully detachable manner to the laser beam printer 1. Moreover, the development apparatus 50 is installed as a development apparatus cartridge in a fully detachable manner to the process cartridge 2*a*.

In the laser beam printer 1 as in the aspects described above, when the surface of the photosensitive drum 20 is uniformly charged by the charger 30 and the laser beam L modulated according to the image information is irradiated from the laser scanner unit 40, an electrostatic latent image is formed on the photosensitive drum 20. This electrostatic latent image is visualized with a toner in the development apparatus 50, and the visual image formed on the photosensitive drum 20 is then carried to a transfer position by the photosensitive drum 20. To reach the transfer position, a recording medium is fed from the feed roller 11 via resist rollers 12 and 13, and the visual image is imprinted on the recording medium by a transfer bias applied by the transfer roller 21. In this case, the remaining toner on the photosensitive drum 20 after the transfer is recovered by the developing roller 59 in the developing chamber 57.

Next, the recording medium is carried to the fixing unit 70 and inserted through the heated roller 71 and the pressing roller 72 in the fixing unit 70 so that the visual image on the recording medium is fixed on the recording medium by application of pressure and heat. The recording medium discharged to an ejection tray 75 above the laser beam printer 1 via a pair of the carriage rollers 73 and the ejection roller 74.

Next, a sealing structure for the prevention of leakage of toner in the development apparatus 50 according to some aspects of the invention will be explained with reference to FIG. 2 or FIG. 4 along with the installation procedures.

Figure 2A:
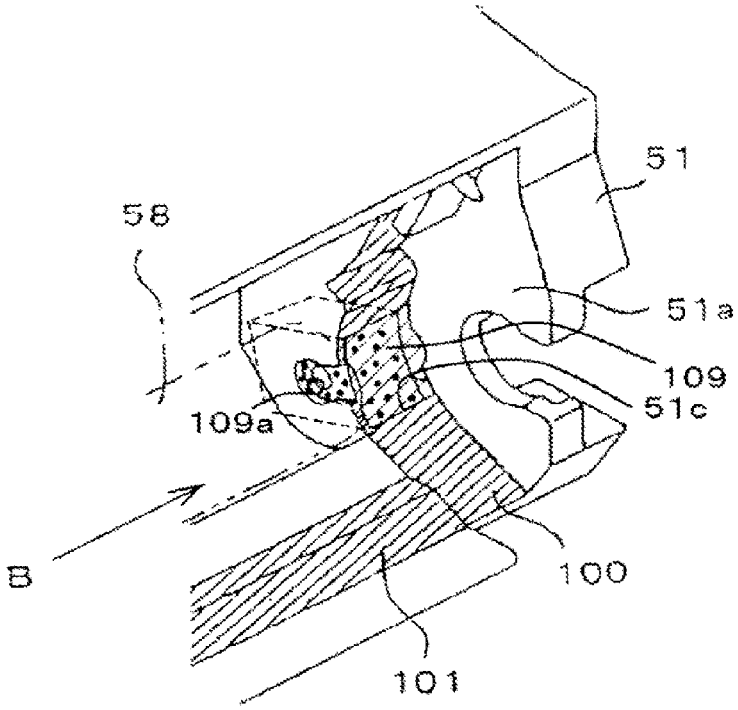
FIG. 2A is a partially dotted oblique view showing sealed units in the development apparatus case before installation of sealing members according to at least one aspect of the invention.
Figure 2B:
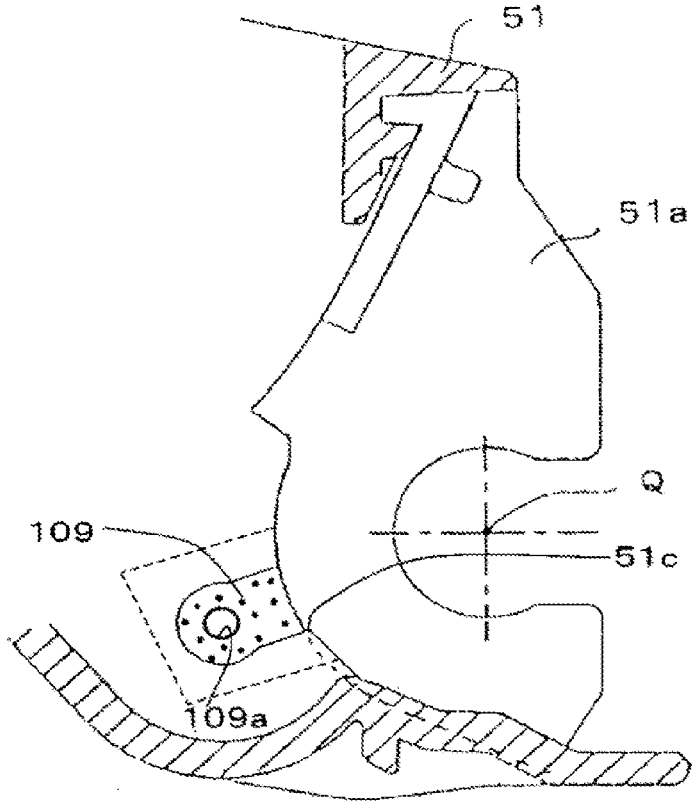
FIG. 2B is a view of the sealed units from the direction of the arrow B shown in FIG. 2A.
Figure 3A:
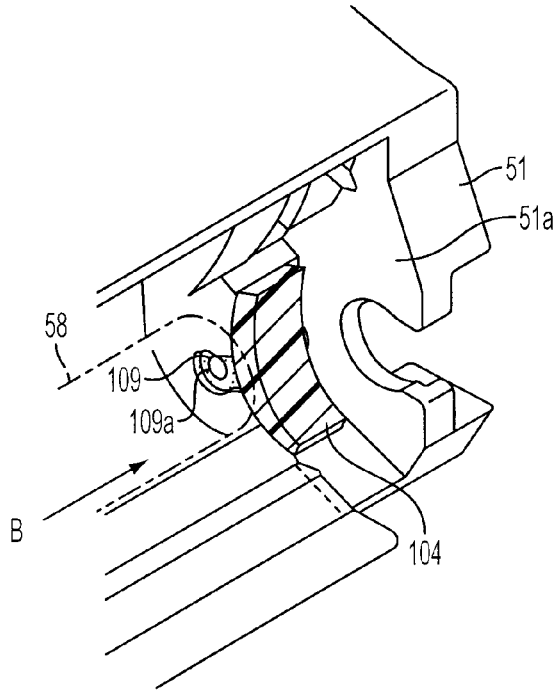
FIG. 3A is a partially dotted oblique view showing sealed units in the development apparatus case when a side seal is installed according to at least one aspect of the invention.
Figure 3B:
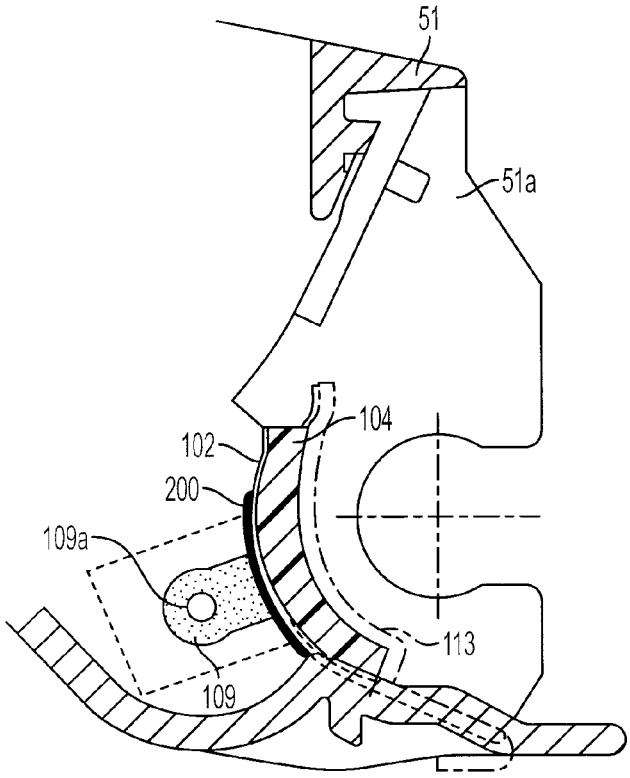
FIG. 3B is a view of the sealed units from the direction of the arrow B shown in FIG. 3A.

FIG. 2A and FIG. 3A are partially dotted oblique views showing a sealing structure of the case 51 in the development apparatus 50 according to at least one aspect of the inventions. Additionally, FIG. 2B and FIG. 3B are the partially dotted oblique views seen from the direction of the arrow B in FIGS. 2A and 3A, respectively.

In FIG. 2A, the area indicated by the oblique lines is installed using a double-faced tape as a double-faced adhesive member as the sealing member explained below, which is divided into a side seal installation area 100 along the circumferential direction of the developing roller 59, and a lower sealed area 101 along the longitudinal direction of the developing roller 59 in the lower position of the developing roller 59.

In the side seal installation area 100 of the case 51, an opening 51*c* for installing the feed roller 58 is formed in order to install a feed roller seal 109. The feed roller seal 109 constitutes a side edge face developer leakage prevention member. The feed roller seal 109 can be a cubic urethane sponge (or other appropriate material that would prevent leakage) forming an opening 109*a* the size of the feed roller shaft 58*a* (see FIG. 1) in the longitudinal direction of the feed roller 58 as indicated by the two-dotted broken parallel lines in FIG. 2A. This feed roller seal 109 is positioned such that it is installed to face the side end face of the feed roller 58, and it is also installed so that one of the edges of the feed roller seal 109 faces a side face of the opening 51*c*. The side end face of the feed roller 58 slides against a portion of the side end face of the side seal 104 (this element is shown in FIG. 3A) and the side face of the feed roller seal 109 so that it prevents leakage of the toner from the side end face of the feed roller 58.

Additionally, the developing roller 59 is arranged such that a side face unit comes close to, but does not contact the side face unit 51*a* of the developing roller storage unit in case 51 shown in FIG. 2A. The center point Q shown in FIG. 2B indicates the position of the central rotational axis of the developing roller 59.

Next, as shown in FIG. 3A and FIG. 3B, in order to prevent leakage of toner from both ends of the developing roller 59, side seal 104 is installed with double-faced tape 102. A Teflon® felt 113 constituting the upper-most layer of an end-to-end developer leakage prevention member is located on the upper face of the side seal 104 and extends to the side seal installation area 100 indicated by the two-dotted lines in FIG. 3B. In FIG. 4, Teflon® felt 113 installed with a double-faced tape 102 is shown to cover the side seal 104. The end-to-end developer leakage prevention member according to illustrative aspects of the present invention includes the side seal 104 and Teflon® felt 113.

The side seal 104 can be formed of a urethane sponge (e.g., Poron™ manufactured by the Rogers INOAC Foam Company) that has relatively high rigidity in comparison to other sponges and it can have a certain thickness to exhibit a specified pressure for compression when the developing roller 59 is installed. For instance, the thickness of the side seal 104 may be approximately 3 mm. When compressed against the developing roller 59, the thickness of the side seal 104 may be approximately 1.5 mm. According to this aspect, the end-to-end developer leakage prevention member can be pressed with a specified pressure against the developing roller 59.

As shown in FIG. 3B, the feed roller seal 109 is laminated with side seal 104 using the double-faced tape 102 adhered on the back of the side seal 104. On the contact surface between the double-faced tape 102 and the feed roller seal 109, a releasing layer 200 containing grease as a releasing agent is formed. The releasing agent may be any material, which allows the double-faced tape 102 and the feed roller seal 109 to be readily separated from each other when necessary (e.g., during servicing). For example, materials used in removing a plastic from a metal mold during a plug molding process could be used. Illustrative releasing agents included, but are not limited to, silicone oil, lubricant oil and fluorine solvents wherein fluorine resin is dispersed (e.g., Hanarl manufactured by Kanto Kasei), fluorine resin powder (e.g., Leblanc manufactured by Daikin Kogyo), silicone resin micro particles (e.g. Tospearl manufactured by Toshiba Silicone), etc. may also be used. In Fig. B, the releasing layer 200 is highlighted as a black layer. The amount of grease or releasing agent for forming the releasing layer 200 should be sufficient to allow the double-faced tape 102 to adhere to the feed roller seal 109 in an operating state while allowing the double-faced tape 102 to be separated from the feed roller seal 200 without damaging (e.g., removing portions of) the feed roller seal 109 in a repair/recycle or disassembly state when the side seal 104 can be removed from the case 51. Additionally, in some aspects a new side seal 104 can be installed where it can be aligned on the contact surface and can be installed in the side seal installation area 100 in the case 51 without generating wrinkles and stretching.

Since the releasing layer 200, such as grease, is constituted in the area partially between the double-faced tape 102 and the case 51, the task of removing the side seal 104 from the case 51 becomes easier.

Additionally, according to one aspect if the releasing layer 200 is constituted only on the contact surface between the double-faced tape 102 and the feed roller seal 109, high adhesive strength of the double-faced tape 102 on the back side of the side seal 104 relative to the case 51 can be maintained so that the leakage between the rotating developing roller 59 and the side seal 104 can be prevented.

The releasing layer 200 containing the releasing agent may also be constituted on the entire surface where the double-faced tape 102 on the back side of the side seal 104 is in contact with the case 51. According to this aspect, the side seal 104 can be easily removed from the case 51 at the time of recycling the development apparatus 50. Since the side seal 104 can be placed at an appropriate position while sliding it in the case 51 due to the lubrication of the releasing agent, stretches or wrinkles may be prevented in the side seal 104. In addition, Teflon® felt 113 can be installed on the side seal 104 over the side seal installation area 100 in the case 51 so that the leakage of toner from the installation point of the side seal 104 may be further prevented while maintaining the adhesive strength between the double-faced tape 102 and the case 51.

Figure 4:
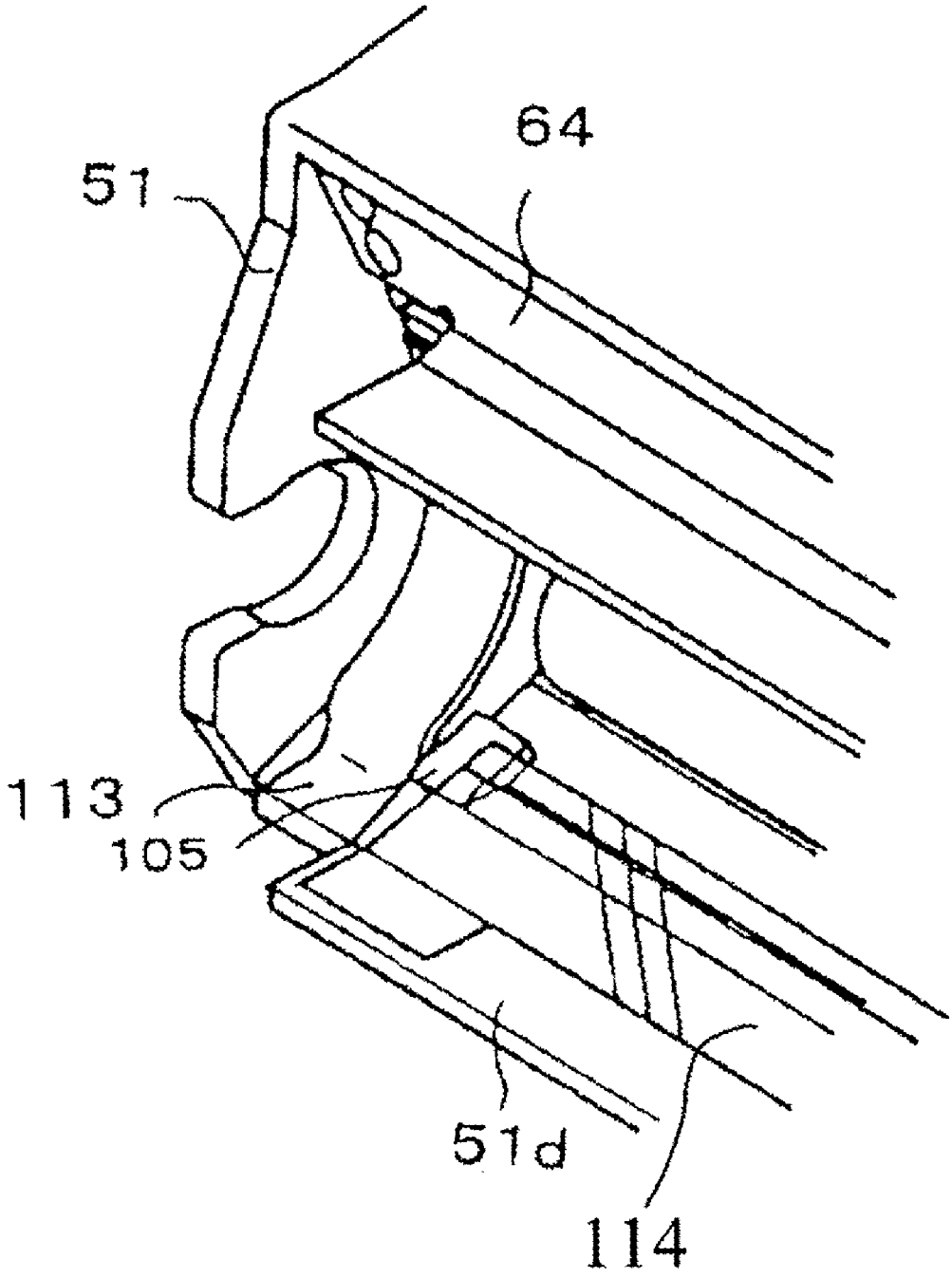
FIG. 4 is a partially dotted oblique view showing sealed units in the case after installing the lower film according to at least one aspect of the invention.

As shown in FIG. 4, a lower side seal 105 and a lower film 114 can be installed in the lower side seal installation area 101 in the case 51. Although a PET (polyethylene terephthalate) sheet or a urethane rubber film may be used as the lower film 114. Using a double-faced tape, a lower film 114 is placed partially on the lower seal installation area 101, a part of the front frame 51*d* of the case 51, and a part of the lower side seal 105 so that the leakage of toner from the lower part in the longitudinal direction of the developing roller 59 in the opening of the development apparatus 50 can be prevented.

Moreover, a layer thickness regulating blade 64 is pressed in the longitudinal direction of the developing roller 59. Since a blade back seal (not shown) is installed between the layer thickness regulating blade 64 and the case 51, the leakage of toner from the upper part in the longitudinal direction of the developing roller 59 can be prevented.

As explained above, the leakage of toner from the upper portion of the developing roller 59 can be prevented by each sealing member in the upper end, end-to-end and the lower end of the development apparatus 50.

When the toner of the development apparatus 50 is being recycled, a releasing layer 200 containing releasing agent is constituted on the contact surface between the double-faced tape 102 on the back of the side seal 104 and the base 51, making the tasks of removal of the side seal 104 from the case 51 and the installation of a side seal 104 into the case 51 relatively easy.

If the releasing layer 200 is constituted on the contact surface between the double-faced tape 102 on the back of the side seal 104 and the feed roller seal 109, the side seal 104 can be removed without damaging the feed roller 109 from the case 51 with a high level of reliability.

Although aspects of the present invention have been described above, the present invention is not limited by to the aforementioned aspects. Various modifications and changes can be made that fall within the scope of the present invention.

The invention claimed is:

1. A development apparatus configured for use in an image forming device comprising:

a developer storage chamber for storing developer;

a developer carrier having a film of the developer formed thereon, wherein a visible image is formed when the film interacts with an electrostatic latent image;

a developer feed member arranged adjacent to an opening of the developer storage chamber and configured to feed developer from the developer storage chamber to the developer carrier;

a first developer leakage prevention member located between the developer feed member and the developer carrier;

an adhesive adhering to the first developer leakage prevention member in a longitudinal direction of the opening; and a layer including an agent formed between the adhesive and the developer feed member.

2. The development apparatus of claim 1, further comprising a second developer leakage prevention member located between the developer feed member and the adhesive.

3. The development apparatus of claim 2, wherein the layer is configured to allow the adhesive to be separated from the second developer leakage prevention member without removing portions of the second developer leakage prevention member.

4. The development apparatus of claim 2, wherein the first developer leakage prevention member and the second developer leakage prevention member include a urethane sponge.

5. The development apparatus of claim 1, wherein the adhesive includes two sides and adheres to the first developer leakage prevention member.

6. The development apparatus of claim 1, wherein the agent is grease.

7. The development apparatus of claim 1, wherein the developer is a polymer toner having spherically shaped particles.

8. The development apparatus of claim 1, wherein the developer is a polymer toner having a particle size ranging from 5 μm to 15 μm.

9. The development apparatus of claim 1, wherein the adhesive is a double-faced tape.

10. The development apparatus of claim 1, further comprising a second developer leakage prevention member located on a side of the first developer leakage member opposite to a side that the adhesive adheres to the first developer leakage member.

11. The development apparatus of claim 10, wherein the second developer leakage prevention member is a felt.

12. A development apparatus configured for use in an image forming device comprising:

a case containing, a developer storage chamber for storing developer;

a developer carrier having a film of the developer formed thereon, wherein a visible image is formed when the film interacts with an electrostatic latent image;

a developer feed member arranged adjacent to an opening of the developer storage chamber and configured to feed developer from the developer storage chamber to the developer carrier;

a first developer leakage prevention member located between the case and the developer carrier;

an adhesive located between the case and the first developer leakage prevention member and adhering to the first developer leakage prevention member in a longitudinal direction of the opening; and a layer including an agent contacting the adhesive and the case.

13. The development apparatus of claim 12, wherein the agent is grease.

14. The development apparatus of claim 12, further comprising a second developer leakage prevention member located between the developer feed member and the first leakage prevention member, and wherein a portion of the adhesive and a portion of the layer are located between the first leakage prevention member and the second leakage prevention member.

15. The development apparatus of claim 14, wherein the layer is configured to allow the adhesive to be separated from the second developer leakage prevention member without removing portions of the second developer leakage prevention member.

16. The development apparatus of claim 14, wherein the first developer leakage prevention member and the second developer leakage prevention member include a urethane sponge.

17. The development apparatus of claim 12, wherein the adhesive includes two-sides and adheres to the case via the layer on a first side and the first leakage prevention member on a second side.

18. The development apparatus of claim 12, wherein the developer is a polymer toner having spherically shaped particles.

19. The development apparatus of claim 12, wherein the developer is a polymer toner having a particle size ranging from 5 μm to 15 μm.

20. The development apparatus of claim 12, wherein the adhesive is a double-faced tape.

21. The development apparatus of claim 12, further comprising a second developer leakage prevention member located on a side of the first developer leakage member opposite to a side that the adhesive adheres to the first developer leakage member.

22. The development apparatus of claim 21, wherein the second developer leakage prevention member is a felt.

23. A process cartridge that is fully detachable from an image forming device comprising:

a carrier of an electrostatic latent image; and a development apparatus including a developer storage chamber for storing developer;

a developer carrier having a film of the developer formed thereon, wherein a visible image is formed when the film interacts with the electrostatic latent image;

a developer feed member arranged adjacent to an opening of the developer storage chamber and configured to feed developer from the developer storage chamber to the developer carrier;

a first developer leakage prevention member located between the developer feed member and the developer carrier;

an adhesive adhering to the first developer leakage prevention member in a longitudinal direction of the opening; and a layer including an agent formed between the adhesive and the developer feed member.

* * * * *

UNITED STATES PATENT AND TRADEMARK OFFICE

CERTIFICATE OF CORRECTION

PATENT NO. : 7,430,383 B2
APPLICATION NO. : 11/467403
DATED : September 30, 2008
INVENTOR(S) : Satoshi Tanabe It is certified that error appears in the above-identified patent and that said Letters Patent is hereby corrected as shown below:

On the Cover Page, Section 73, the Assignee:
Please delete "Nagoy-shi" and insert --Nagoya-shi--

Signed and Sealed this

Sixteenth Day of June, 2009

JOHN DOLL
*Acting Director of the United States Patent and Trademark Office*